US010995950B2

(12) United States Patent
Deivasigamani et al.

(10) Patent No.: US 10,995,950 B2
(45) Date of Patent: May 4, 2021

(54) BURNER RESONANCE CANCELING APPARATUS

(71) Applicant: Intellihot, Inc., Galesburg, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 234 days.

(21) Appl. No.: 16/382,252

(22) Filed: Apr. 12, 2019

(65) Prior Publication Data

US 2019/0234613 A1 Aug. 1, 2019

Related U.S. Application Data

(63) Continuation-in-part of application No. 15/173,664, filed on Jun. 5, 2016, now Pat. No. 10,260,741.

(60) Provisional application No. 62/171,238, filed on Jun. 5, 2015.

(51) Int. Cl.
*F23D 14/14* (2006.01)
*F23D 14/46* (2006.01)

(52) U.S. Cl.
CPC ..... *F23D 14/46* (2013.01); *F23D 14/14* (2013.01); *F23D 2210/00* (2013.01); *F23R 2900/00014* (2013.01)

(58) Field of Classification Search
CPC ..... F23D 14/46; F23D 14/02
USPC ..... 431/329, 116, 328
See application file for complete search history.

(56) References Cited

U.S. PATENT DOCUMENTS 3,975,141 A * 8/1976 Sweet ..... F23R 3/14 431/352
6,065,963 A * 5/2000 Dewaegheneire ..... D04B 1/14 431/329
6,428,312 B1 8/2002 Smelcer et al.

* cited by examiner

*Primary Examiner* — Avinash A Savani
(74) *Attorney, Agent, or Firm* — Tracy Jong Law Firm; Tracy P. Jong; Cheng Ning Jong

(57) ABSTRACT

A burner including a burner tube including a side wall, a first longitudinal end configured for receiving a fuel mixture flow, a closed second longitudinal end, a chamber defined by the interior flow space of the burner tube, the cross-sectional area of the burner tube is larger at the first longitudinal end than the cross-sectional area of the burner tube at the second longitudinal end; and a plate disposed on the first longitudinal end, isolating the chamber from a space upstream of the chamber, the plate further includes a plurality of openings disposed in a spiral format on the plate and a plurality of baffles, each baffle coupled to one of the plurality of openings of the plate, each of the plurality of baffles is configured to direct a portion of the fuel mixture flow through one of the openings from the space upstream of the chamber into the chamber.

19 Claims, 10 Drawing Sheets

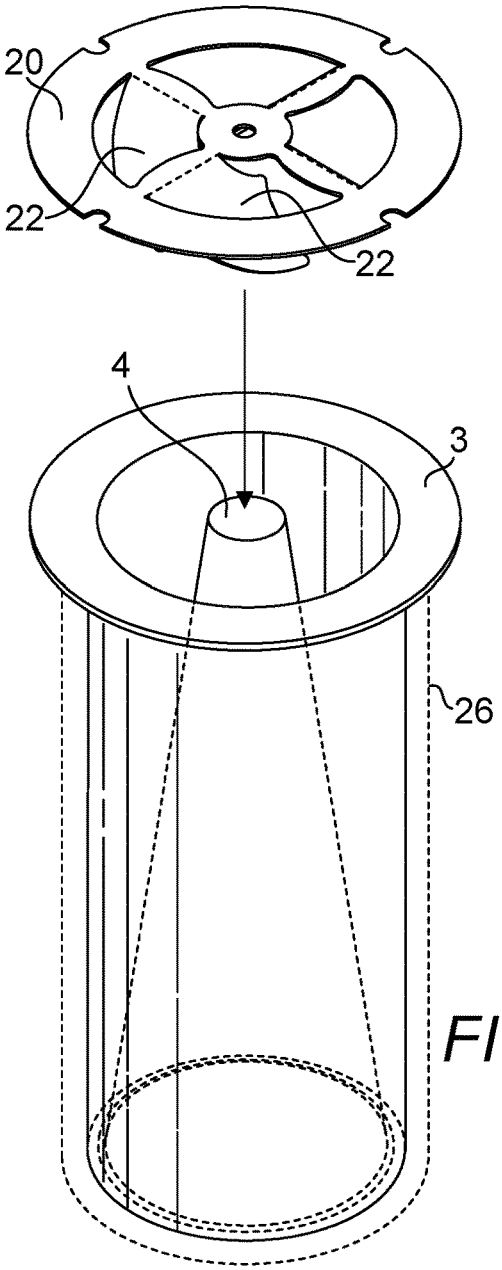
FIG. 10
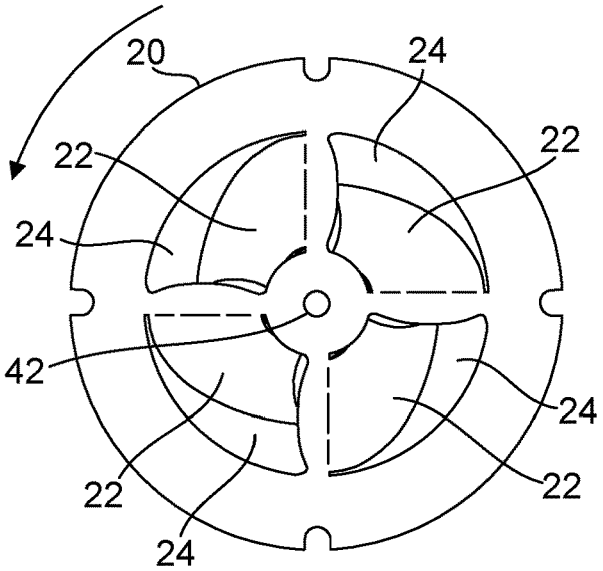
FIG. 11
FIG. 12
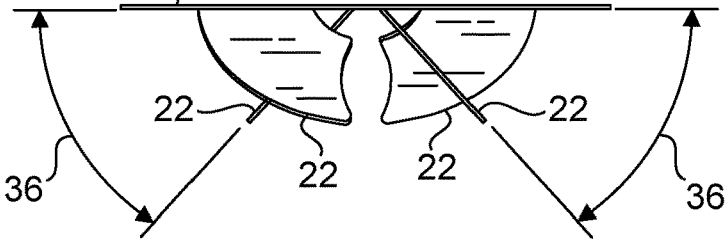

BURNER RESONANCE CANCELING APPARATUS

PRIORITY CLAIM AND RELATED APPLICATIONS

This continuation-in-part application claims the benefit of priority from non-provisional application U.S. Ser. No. 15/173,664 filed Jun. 5, 2016 and U.S. Ser. No. 62/171,238 filed Jun. 5, 2015. Each of said applications is incorporated by reference in its entirety.

BACKGROUND OF THE INVENTION

1. The Field of the Invention

The present invention is directed generally to an apparatus for canceling resonance created in a burner. More specifically, the present invention is directed to an apparatus for canceling resonance in burner created when the burner demand changes rapidly from a medium or high demand to a low demand or when the burner demand is set at an even lower level.

2. Background Art

When a burner demand is altered rapidly from a medium or high demand to a low demand, e.g., in a burner with high turndown, the now lowered fuel/air mixture flowrate can cause a resonance in the burner hardware, e.g., the burner tube, which is audible. Further, this also causes poor combustion at the burner, resulting in high carbon monoxide (CO) and nitrogen oxide (NOX) contents in the exhaust of the burner.

U.S. Pat. No. 6,428,312 to Smelcer et al. (hereinafter Smelcer) discloses a burner apparatus including a foraminous burner surface having a multitude of openings through which flames can extend. The burner surface is irregularly shaped so that flames extending from the openings are directed in an irregular pattern whereby eddy currents are generated and effectively disrupt oscillation of the flames to result in reduced noise generation from flame oscillation. Smelcer's means for eliminating burner resonance involves making the surface of a burner irregular. Such practice requires significant changes to conventional burners to result in the irregularly shaped burner surfaces. It may be impractical to modify an existing burner to result in Smelcer's burner. In addition, the modification involves adding or using a component which comes in direct contact with flames during combustion and therefore the burner surface material must be made from a substance which can withstand such use. Further, if Smelcer's concept were to be applied to an existing burner to result in a rigid burner having an irregular surface, the amount of modification and/or level of effort required are even greater.

Thus, there is a need for a burner capable of mitigating the effects of burner resonance or an apparatus capable of being adapted to a burner to mitigate the effects of burner resonance and in at least one version, doing it without requiring a complete change-out of existing burners or significant additions to the existing burners.

SUMMARY OF THE INVENTION

In accordance with the present invention, there is provided a burner including:

(a) a burner tube including a side wall, a plurality of apertures disposed on the side wall, a first longitudinal end configured for receiving a fuel mixture flow, a closed second longitudinal end, a chamber defined by the interior flow space of the burner tube, the cross-sectional area of the burner tube is larger at the first longitudinal end than the cross-sectional area of the burner tube at the second longitudinal end; and (b) a plate disposed on the first longitudinal end of the burner tube, isolating the chamber from a space upstream of the chamber, the plate further includes a plurality of openings disposed in a spiral format on the plate and a plurality of baffles, each baffle coupled to one of the plurality of openings of the plate, each of the plurality of baffles is configured to direct a portion of the fuel mixture flow through one of the plurality of openings from the space upstream of the chamber into the chamber, which together, form a confluent flow in a spiral format in the chamber and subsequently exit through the plurality of apertures of the burner tube, whereby one of a flowrate-induced burner resonance and a flowrate change-induced burner resonance is mitigated.

In one embodiment, at least one of the baffles is disposed at an angle of about 48 degrees with respect to the plate.

In one embodiment, the flowrate-induced burner resonance is a condition wherein the fuel mixture flowrate is under about 36 kbtu/hr. In one embodiment, the flowrate change-induced burner resonance is a condition wherein the fuel mixture flowrate decreases from over about 100 kbtu/hr to under about 40 kbtu/hr.

In one embodiment, the cross-sectional area of the burner tube is larger at the first longitudinal end than the cross-sectional area of the burner tube at the second longitudinal end due at least in part to a conically shaped member being disposed within the burner tube. In one embodiment, the cross-sectional area of the burner tube is larger at the first longitudinal end than the cross-sectional area of the burner tube at the second longitudinal end due at least in part to a frusto-conically shaped member being disposed within the burner tube.

In one embodiment, the burner tube is configured to taper inwardly from the first longitudinal end of the burner tube to the second longitudinal end of the burner tube.

In one embodiment, the chamber is configured such that the fuel mixture flowrate is maintained from the first longitudinal end of the burner tube to the second longitudinal end of the burner tube.

In accordance with the present invention, there is further provided a burner resonance canceling apparatus adapted to a burner tube including a side wall, a plurality of apertures disposed on the side wall, a first longitudinal end configured for receiving a fuel mixture flow, a closed second longitudinal end, a chamber defined by the interior flow space of the burner tube, the cross-sectional area of the burner tube is larger at the first longitudinal end than the cross-sectional area of the burner tube at the second longitudinal end, the burner resonance canceling apparatus includes:

a plate disposed on the first longitudinal end of the burner tube, isolating the chamber from a space upstream of the chamber, the plate further includes a plurality of openings disposed in a spiral format on the plate and a plurality of baffles, each baffle coupled to one of the plurality of openings of the plate, each of the plurality of baffles is configured to direct a portion of the fuel mixture flow through one of the plurality of openings from the space upstream of the chamber into the chamber, which together, form a confluent flow in a spiral format in the chamber and subsequently exit through the plurality of apertures of the burner tube, whereby one of a flowrate-induced burner resonance and a flowrate change-induced burner resonance is mitigated.

An object of the present invention is to provide an apparatus which when installed in a burner, eliminates resonance and its byproduct, noise, experienced in a burner.

Another object of the present invention is to provide an apparatus for eliminating resonance and its byproduct, noise, experienced in an existing burner that can be retrofitted in the existing burner.

Another object of the present invention is to provide an apparatus for eliminating resonance and its byproduct, noise, experienced in an existing burner that can be retrofitted in the existing burner without requiring significant changes to the existing burner.

Another object of the present invention is to provide a burner having an apparatus for preventing resonance from occurring due to flowrate reductions and low flowrates of its fuel mixture.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 10 is a top perspective view of the embodiment of the burner shown in FIG. 9, depicting the insert that has been placed within the burner tube.

FIG. 11 is a top view of the plate shown in FIG. 10.

FIG. 12 is a side view of the plate shown in FIG. 10.

PARTS LIST

2—burner
3—burner tube
4—insert or member
5—side wall of burner tube
6—flat surface
8—fuel mixture flow
10—diameter of flat surface of insert
12—height of insert
14—diameter of base of insert
16—diameter of burner tube
18—height of burner tube
20—plate
22—diverter or baffle
24—opening
26—mesh
28—coil tube
30—aperture of burner tube
32—central axis of burner tube
34—central axis of insert
36—bend angle
38—bend line
40—cutout
42—center of plate

PARTICULAR ADVANTAGES OF THE INVENTION

By inserting a cone into a burner tube, the velocity of a fuel mixture flow is increased as the flow travels from a fuel mixture flow receiving end of the burner tube to a longitudinal end opposite that of the receiving end. As the fuel mixture flowrate is decreased, the flame that was previously lifted from a mesh settles towards the burner. As the fuel mixture flowrate is low, it becomes even more difficult to have the fuel mixture flow mixed well. Without an insert and at low fuel mixture flowrate, the flame tends to oscillate about the mesh or on the outer surface of the burner tube, generating undesired resonance in the mixture flow and hence the burner which can cause noise and vibration. With an insert, such resonance is mitigated as the flame is lifted appropriately from the outer surface of the burner tube or the mesh.

In one embodiment, a plate having "cheese grate" type apertures disposed in a spiral pattern is interposed between a top casting and a burner to promote mixing of the fuel mixture flow and to prevent burner chamber pressure pulses to feed back onto the gas valve that is disposed upstream of the chamber, thereby reducing the resonance that can potentially be caused without such apparatus.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
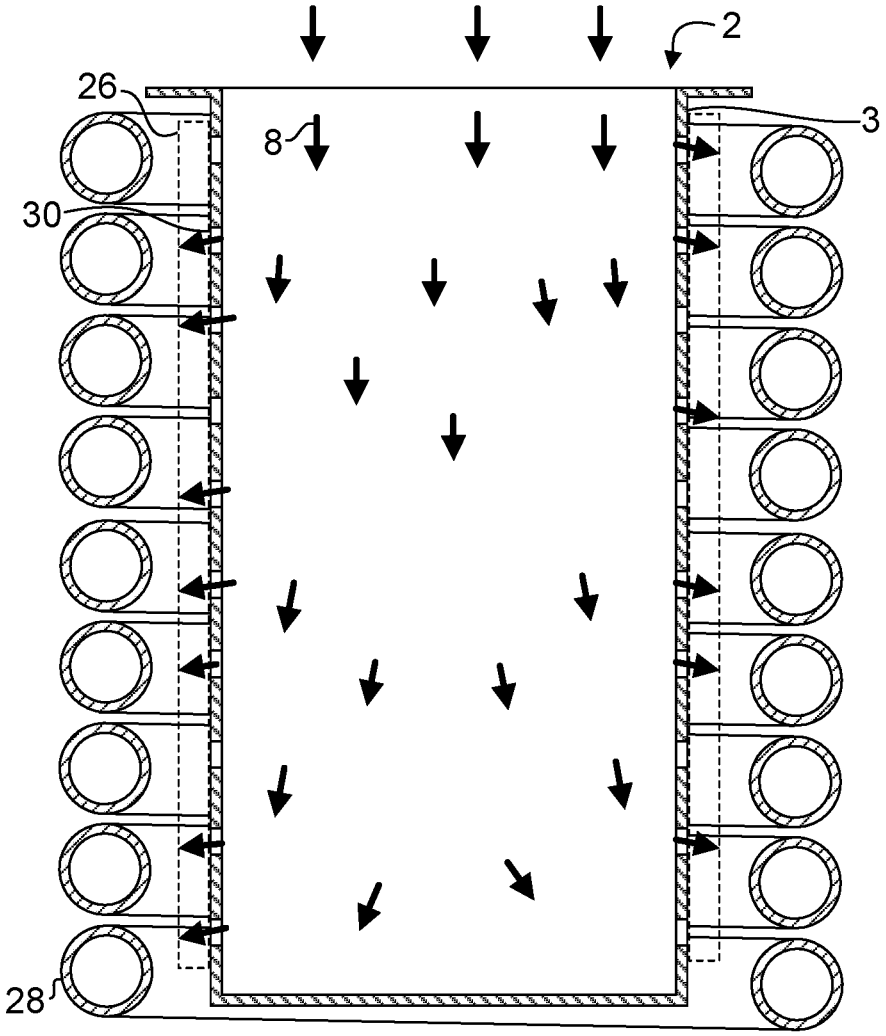
FIG. 1 is a cross-sectional view of a burner without a resonance canceling apparatus.
Figure 2:
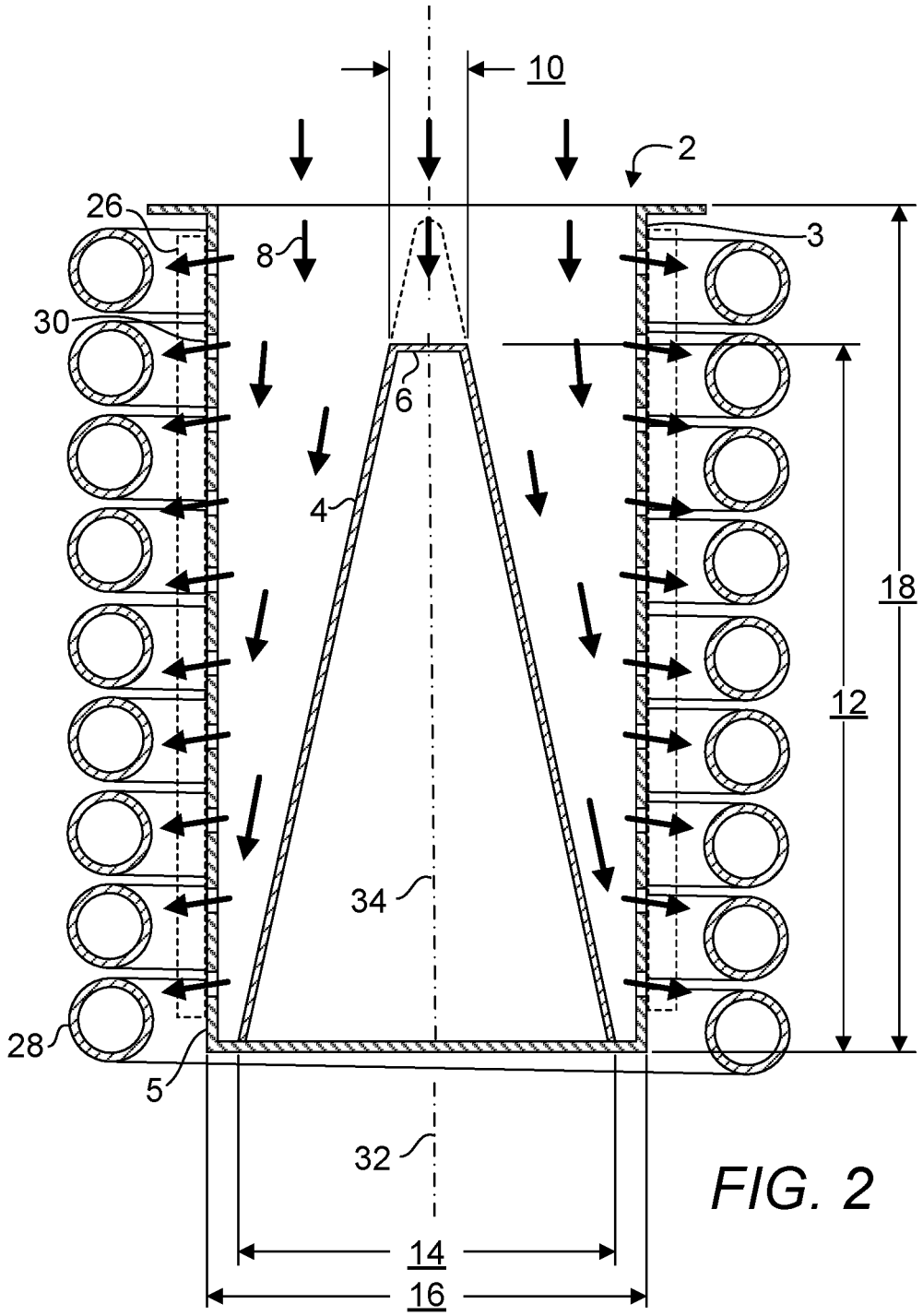
FIG. 2 is a cross-sectional view of a burner having one embodiment of an apparatus for canceling resonance that can potentially be generated within the burner due to a change in the burner demand or a low demand, depicting a mixture mass flowrate that is maintained as it advances through the burner.
Figure 3:
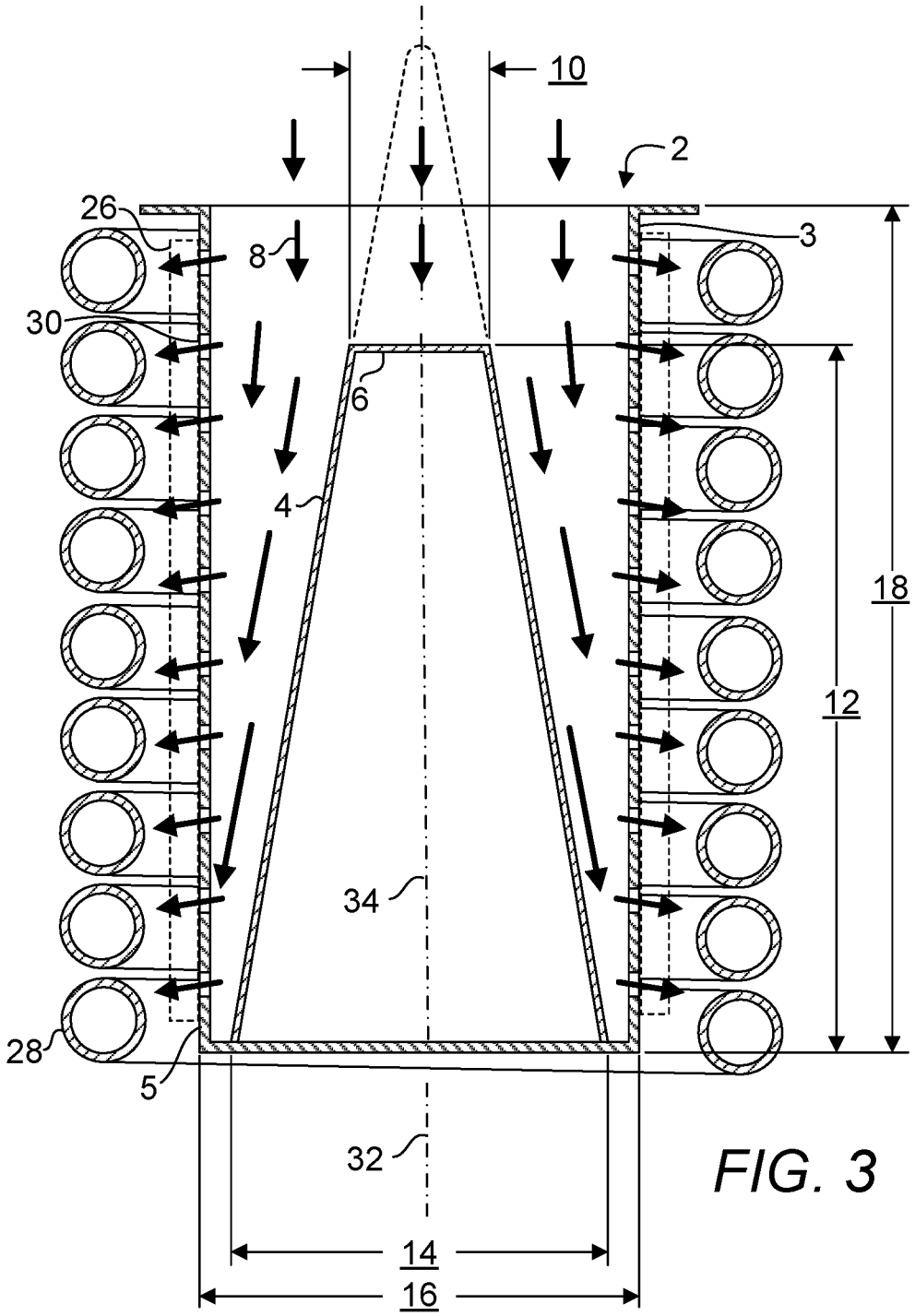
FIG. 3 is a cross-sectional view of a burner having one embodiment of an apparatus for canceling resonance that can potentially be generated within the burner due to a change in the burner demand or a low demand, depicting a mixture mass flowrate that is increased as it advances through the burner.

FIG. 1 is a cross-sectional view of a burner without a resonance canceling apparatus. As shown, a burner tube 3 is disposed within the lumen of a coil tube 28, e.g., in a coil tube heat exchanger. Reference is made to at least FIG. 2 of U.S. Pat. No. 8,656,867 to Deivasigamani et al. for a coil tube heat exchanger employing a burner tube. The burner tube 3 is configured to receive a fuel mixture (fuel, e.g., propane, natural gas, etc. and air) flow through its cavity that eventually leads to the mesh 26 where the mixture is combusted to generate heat subsequently transferred to a flow, e.g., water flow, through the coil tube 28. For illustration purposes, the length of the arrows depicted in FIGS. 1-7 is used to represent the magnitude of the velocity of the mixture flow. Therefore, longer arrows represent flows with higher velocity while shorter arrows represent flows with lower velocity. Referring back to FIG. 1, it can be shown that, at low flowrates, or when a flowrate drops from a high level to a low level (as represented by the magnitude or length of the arrows), there may be discontinuities in the flow as the fuel mixture flowrate magnitude decreases upon entering the burner tube cavity. In contrast, FIGS. 2-3 depict cases where the fuel mixture flowrate is maintained. In a burner according to FIG. 1, if the fuel mixture flowrate drops beyond a minimum flowrate threshold, i.e., under about 36 kbtu/hr or about 0.6 Cubic Feet per Minute (CFM), a burner resonance will start to develop. A burner resonance also occurs when the fuel mixture flowrate decreases from over about 100 kbtu/hr or about 1.67 CFM to under about 40 kbtu/hr or about 0.67 CFM.

FIG. 2 is a cross-sectional view of a burner having one embodiment of an apparatus for canceling resonance that can potentially be generated within the burner due to a change in the burner demand or a low demand, depicting a mixture flowrate that is maintained as it advances through the burner. The burner tube 3 and the member 4 cooperate to define a chamber. As the longitudinal cross-sectional area of the burner tube of the chamber decreases from the mixture receiving end of the burner tube to the closed end, the mixture velocity increases as represented by the increased length of the arrows. FIG. 3 is a cross-sectional view of a burner 2 having one embodiment of an apparatus or insert 4 for canceling resonance that can potentially be generated around the burner due to a change in the burner demand or a low demand. It shall be noted that the magnitude of the arrows increases as the mixture approaches the closed end of the burner tube 3, with larger increases for the flow shown in FIG. 3, as the cross-sectional area of the chamber decreases (with a larger diameter 10 of the flat surface of the insert 4). A burner whose resonance the present apparatus is designed to eliminate, has a burner tube 3 including a side wall 5, a plurality of apertures 30 disposed on the side wall 5, a first longitudinal end configured for receiving a fuel mixture flow 8 and a closed second longitudinal end. For simplicity, only outlines of mesh materials are depicted in FIGS. 1-7 to show the approximate locations of such materials. The burner resonance canceling apparatus or insert 4 includes a member having an enlarged end, a reduced end and a central axis 34 extending through the enlarged end and the reduced end. The enlarged end is positioned on the closed second longitudinal end. In one embodiment, the member 4 is simply disposed on the interior surface of the burner tube 3 at the second longitudinal end. In another embodiment, the member 4 is securely attached to the interior surface. The member 4 is preferably disposed symmetrically within the burner tube 3, i.e., the member 4 is preferably disposed such that the central axis 34 of the member 4 is disposed substantially coaxially with the central axis 32 of the burner tube 3. The reduced end of the member 4 is configured to face the fuel mixture flow forced, e.g., using a blower, through the first longitudinal end into the burner tube 3 as it traverses the chamber from the first longitudinal end to the second longitudinal end before exiting the apertures 30 of the burner tube 3. As a burner demand drops, the rate at which a fuel mixture flow is provided to the burner tube is reduced. This drop in flowrate may be effected, e.g., by lowering the fan speed of a blower which drives the fuel mixture flow into the burner tube 3 to sustain combustion at the mesh materials 26. The velocity of the fuel mixture flow increases as the fuel mixture travels from the first longitudinal end with a larger cross-sectional area to the second longitudinal end with a smaller cross-sectional area. The increase in velocity balances a decrease in velocity of the fuel mixture flow as the ensuing flue gas (developed downstream of combustion or mesh materials) pressure pulses travel back into the burner, thereby isolating the gas valve and other equipment disposed outside of the burner tube 3 from the burner dynamics. Burner resonance occurs when heat release due to combustion is in phase with fuel-air mixture delivery. Once resonance starts, it persists to become a self-excited vibration. Fuel burning at the burner releases heat which causes pressure increase/oscillation which in turn causes the fuel mixture flow to move back and forth and hence creating resonance and noise when it interacts with the burner tube 3 and other components along the mixture flow path, e.g., gas valve, etc.

In one preferred embodiment, the burner tube 3 is cylindrically shaped. In one embodiment, the member 4 is configured to taper inwardly from the enlarged end (base of member) to the reduced end (tip of member). In one embodiment, the member 4 is a cone, i.e., with the tip of the member being a sharp point, as shown in dashed outlines in FIGS. 2-3 and 6. In the embodiment shown in FIGS. 2-3, the member 4 is a frusto-cone member. In one embodiment, a plurality of protrusions are disposed on the surface of each member to aid in swirling the fuel mixture flow to create a more evenly mixed air-fuel flow.

In one embodiment, the height 18 of the burner tube 3 is about 168 mm, the height of the insert 4 is about 155 mm, the diameter 16 of the burner tube 3 is about 60 mm and the diameter 14 of the base of the insert is about 58 mm. It shall be noted that as the fuel mixture flow 8 proceeds in the burner 2 when forced into the chamber with a blower, its velocity increases since the cross-sectional area of the fuel mixture flow decreases. In one embodiment, the diameter 10 of the reduced end of the insert 4 is about 21 mm. In one embodiment, the height 12 of the insert 4 is about 137 mm.

Figure 4:
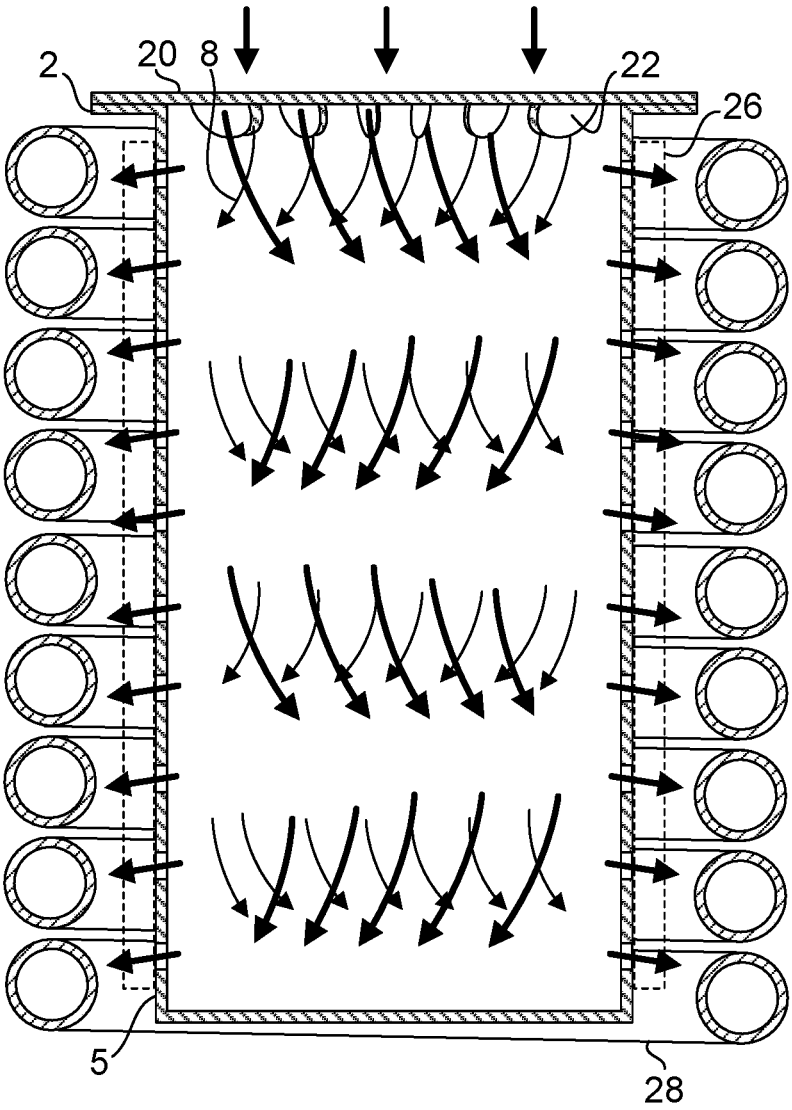
FIG. 4 is a cross-sectional view of a burner having yet another embodiment of an apparatus for canceling resonance that can potentially be generated within the burner due to a change in the burner demand or a low demand, depicting a mixture mass flowrate that is increased as it advances through the burner.
Figure 5:
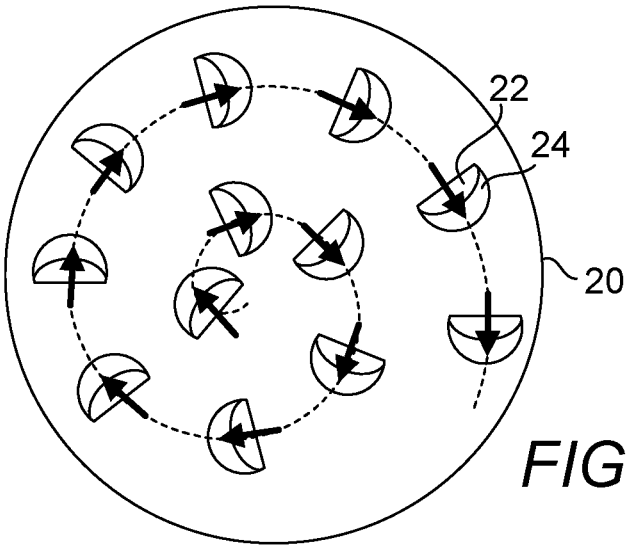
FIG. 5 is a top view of a plate configured to enhance mixing of a fuel and air flow and to ensure the mass flowrate of such mixture is maintained within the chamber shown in FIG. 4.

FIG. 4 is a cross-sectional view of a burner 2 having another embodiment of an apparatus 4 for canceling resonance that can potentially be generated around the burner 2 due to a change in the burner demand or a low demand. FIG. 5 is a top view of a plate 20 configured to enhance mixing of a fuel and air flow and guide portions of the flow in a spiral format. In this embodiment, the plate 20 is interposed between a flange of a burner tube and the top casting of a heat exchanger such that a fuel mixture flow must traverse the plate 20 as it is forced fed with a blower from the top casting to the burner tube 3. In this embodiment, the entire interior flow space of the burner tube defines a chamber as it does not require an insert as shown in the embodiments shown in FIGS. 2-3. The apparatus includes a plate disposed on the first longitudinal end, isolating the chamber from a space upstream of the chamber in which the fuel mixture flow originates. The plate includes a plurality of openings and a plurality of diverters or baffles 22 configured to allow the fuel mixture flow from the space upstream of the chamber into the chamber and enhances mixing of the fuel mixture flow brought through the first longitudinal end via openings 24 into the chamber and subsequently through the plurality of apertures 30 of the burner tube. In one embodiment, the openings 24 and baffles 22 of the plate are obtained by cutting a plate with a plurality of semi-circular-shaped tool tips and pushing resulting flaps to yield "cheese grate" type openings and diverters or baffles. In one embodiment, the openings 24 are disposed in a spiral pattern. The plurality of baffles 22 are configured to direct portions of the fuel mixture flow through the plurality of openings 24 from the space upstream of the chamber into the chamber, which together, form a confluent flow in a spiral format in the chamber and subsequently through the plurality of apertures of the burner tube. The baffles may also be purpose-built as long as at least a portion of each baffle protrudes into the path of the fuel mixture flow to induce swirling of the fuel mixture flow to promote mixing of the fuel mixture flow and to guide the flow in a desired path. Using the present plate, insert or a combination of the two, resonance caused by the decreased flowrate of the fuel mixture flow in the burner can be mitigated.

Figure 6:
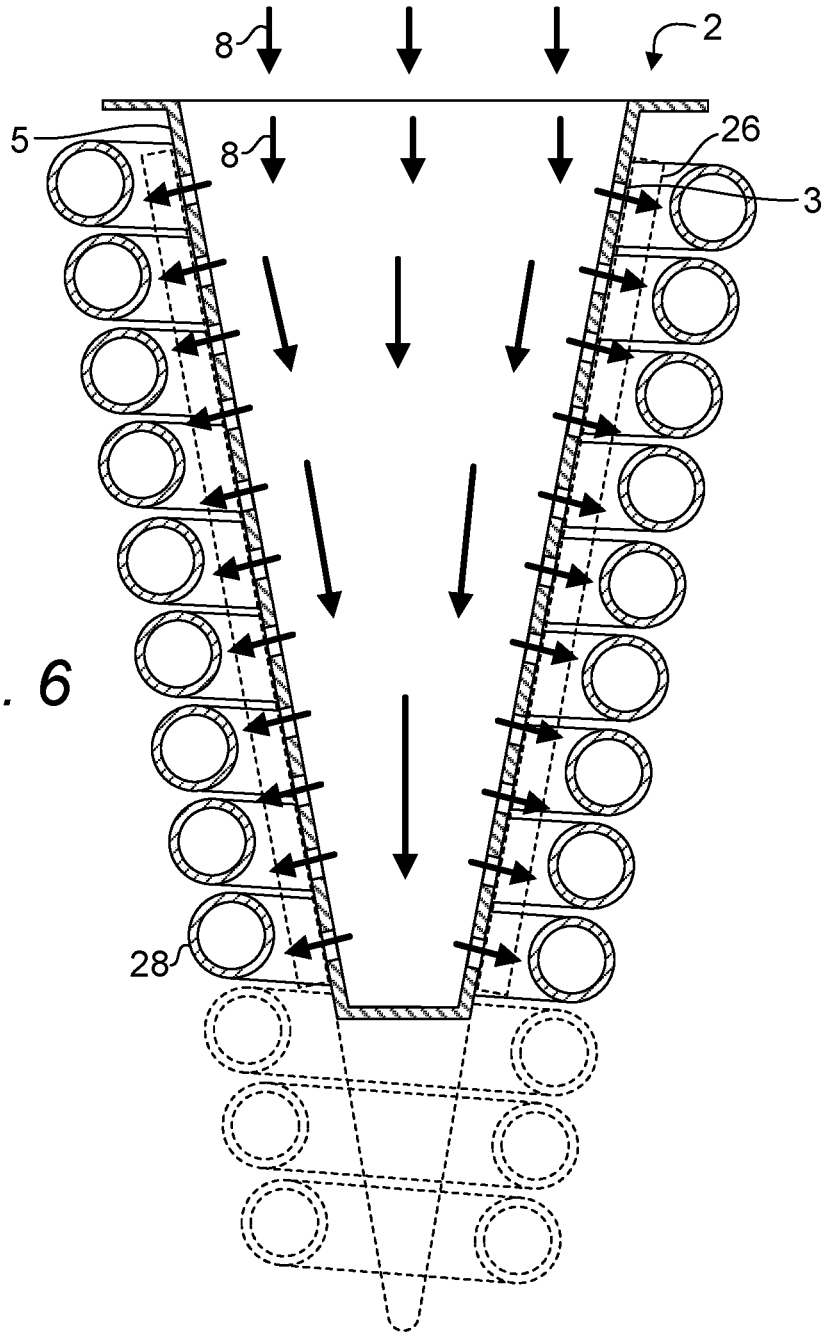
FIG. 6 is a cross-sectional view of a burner having yet another embodiment of an apparatus for canceling resonance that can potentially be generated within the burner due to a change in the burner demand or a low demand, depicting a coil tube that is configured in the shape of the burner.
Figure 7:
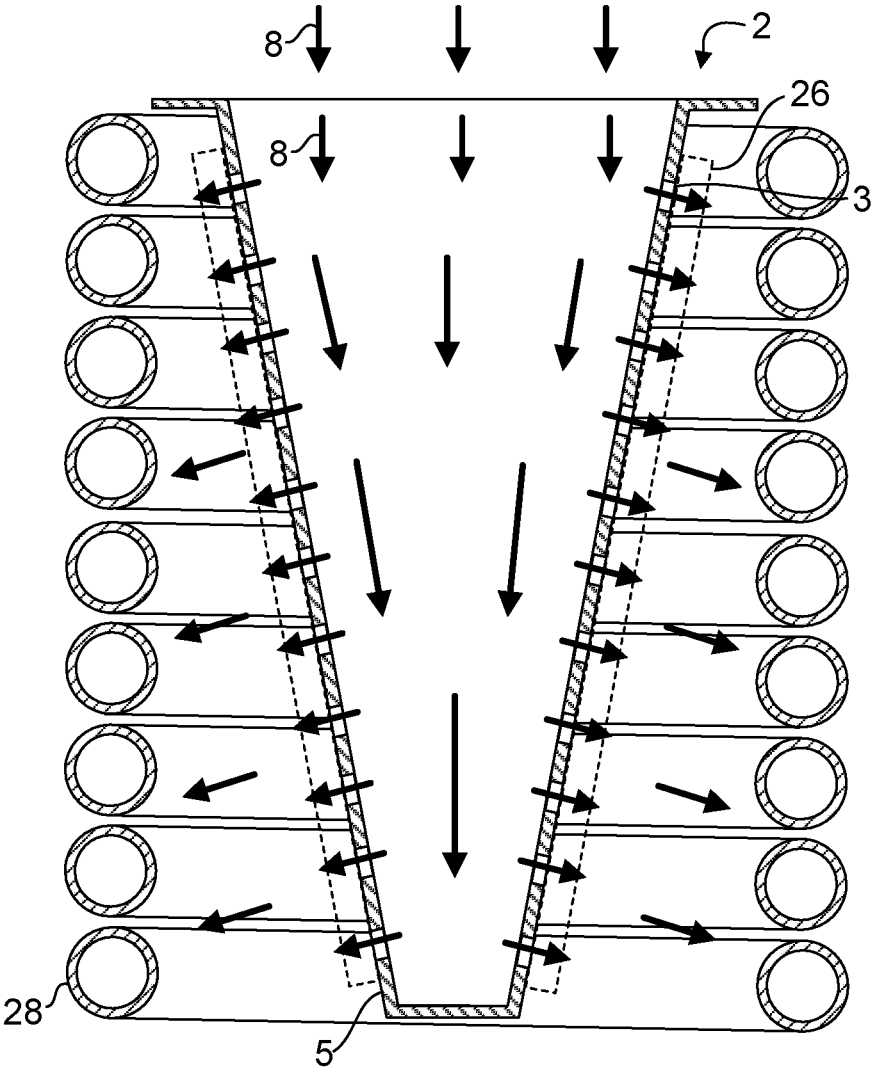
FIG. 7 is a cross-sectional view of a burner having yet another embodiment of an apparatus for canceling resonance that can potentially be generated within the burner due to a change in the burner demand or a low demand, depicting a cylindrical coil tube used with the burner.

FIG. 6 is a cross-sectional view of a burner 2 having yet another embodiment of an apparatus for canceling resonance that can potentially be generated within the burner due to a change in the burner demand or a low demand. In this embodiment, instead of a cylindrically shaped burner tube as shown in FIG. 3, the burner tube 3 is conically shaped with the first end being the enlarged end and the second closed end being the reduced end. It shall be noted that, similar to the chamber of the burner tube 3 of FIGS. 2-3, the burner tube of FIG. 6 also shows a diminishing cross-sectional area in the direction from the first end of the burner tube 3 to the second end of the burner tube 3. The coil tube 28 is preferably shaped similarly such that the distance between the coil tube 28 and the burner 2 is maintained at a distance suitable for heat transfer from the burner 2 to the coil tube 28. However, if increased exposure, e.g., length of a coil tube to the burner tube is desired, a cylindrical coil may alternatively be used as shown in FIG. 7.

Figure 8:
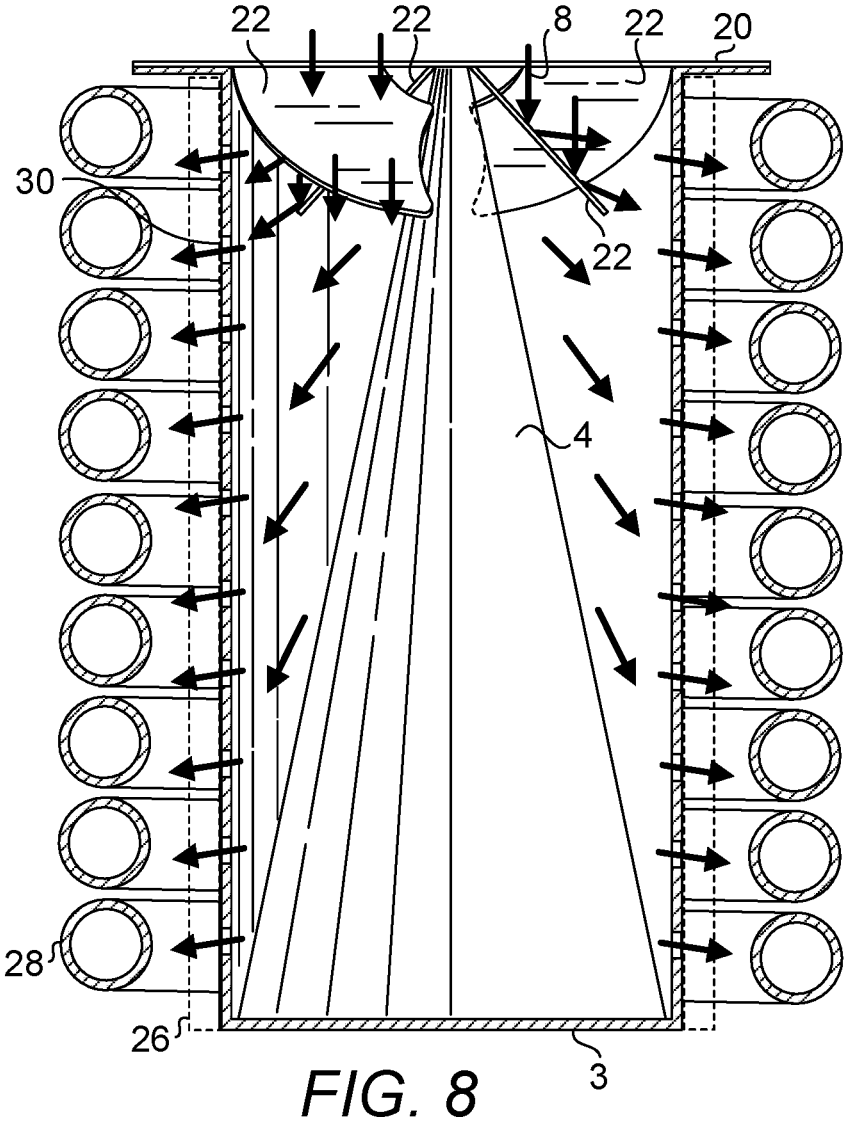
FIG. 8 is a side cross-sectional view of a burner tube of yet another embodiment of a burner, revealing an insert and a plate 20 configured to enhance mixing of a fuel and air flow and guide the flow into the burner tube.
Figure 9:
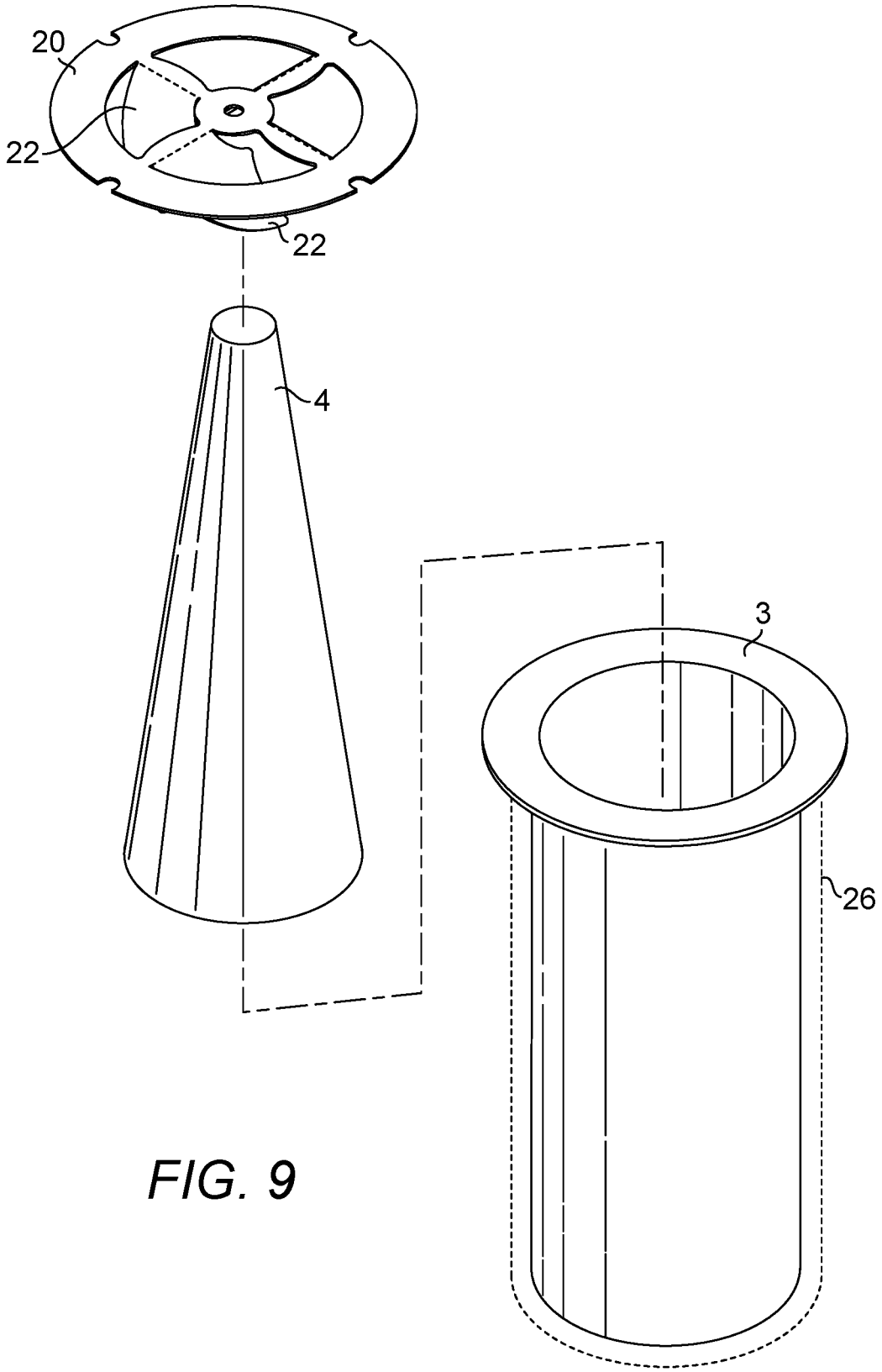
FIG. 9 is a top exploded perspective view of the embodiment of the burner shown in FIG. 8.
Figure 13:
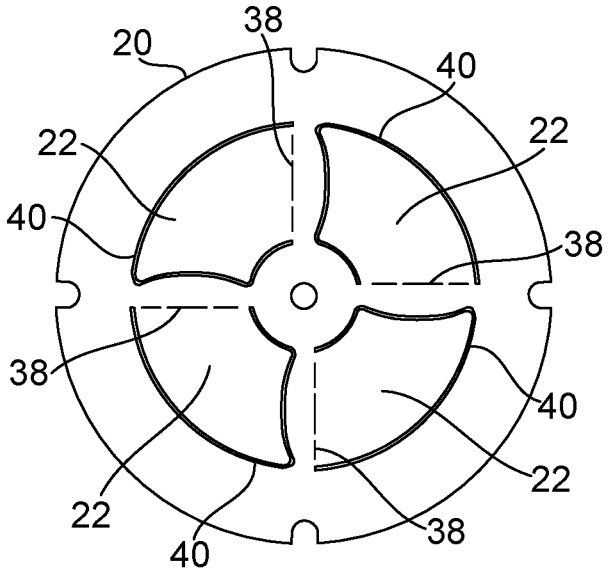
FIG. 13 is top view of the plate shown in FIG. 10 prior to a bending step that bends the baffles into their final configuration.

FIG. 8 is a side cross-sectional view of a burner tube of yet another embodiment of a burner, revealing an insert 4 and a plate 20 configured to enhance mixing of a fuel and air flow and guide the flow into the burner tube. FIG. 9 is a top exploded perspective view of the embodiment of the burner shown in FIG. 8. FIG. 10 is a top perspective view of the embodiment of the burner shown in FIG. 9, depicting the insert that has been placed within the burner tube 3. FIG. 11 is a top view of the plate 20 shown in FIG. 10. FIG. 12 is a side view of the plate 20 shown in FIG. 10. FIG. 13 is top view of the plate 20 shown in FIG. 10 prior to a bending step that bends the baffles 22 into their final configuration. In this embodiment, the plate 20 is interposed between a flange of a burner tube 3 and the top casting of a heat exchanger such that a fuel mixture flow must traverse the plate 20 as it is forced fed with a blower from the top casting to the burner tube 3. It shall be noted that the insert 4 is similar to those disclosed elsewhere herein. The burner includes a plate 20 disposed on the first longitudinal end, isolating the chamber of the burner tube from a space upstream of the chamber in which the fuel mixture flow originates. Referring to FIGS. 8 and 11, the plate 20 includes a plurality of openings 24 and a plurality of diverters or baffles 22 configured to allow the fuel mixture flow from the space upstream of the chamber into the chamber and enhances mixing of the fuel mixture flow brought through the first longitudinal end via openings 24 into the chamber of the burner tube 3 and subsequently through the plurality of apertures 30 of the burner tube. Referring to FIG. 11, it shall be noted that the baffles 22 are arranged in a spiral format in the direction indicated by the arrow about the center of the plate 42. The total area of the openings 24 is about 80% of the cross-sectional area of the first longitudinal end of the burner tube 3. In one embodiment, the openings 24 and baffles 22 of the plate are obtained by impacting a plate with a plurality of leaf-shaped cutting or stamping tool tips to result in leaf-shaped flaps surrounded by cutouts 40 and bending resulting flaps along bend lines 38 to yield openings 24 in the same shape and diverters or baffles 22. The plurality of baffles 22 are configured to direct portions of the fuel mixture flow through the plurality of openings 24 from the space upstream of the chamber into the chamber, which together, form a confluent flow in a spiral format in the chamber and subsequently through the plurality of apertures 30 of the burner tube 3. The baffles 22 may also be purpose-built as long as at least a portion of each baffle 22 protrudes into the path of the fuel mixture flow to induce swirling of the fuel mixture flow to promote mixing of the fuel mixture flow and to guide the flow in a desired path. Using the present plate 20, insert 4 or a combination of the two, resonance caused by the decreased flowrate of the fuel mixture flow in the burner can be mitigated. In one embodiment not shown, a burner tube 3 shaped according to the embodiment shown in FIG. 6 or 7 can be used along with the plate 20 shown in FIGS. 8-12 instead of the burner tube 3 and insert 4 shown in FIG. 8. Referring to FIG. 12, in one embodiment, the baffles 22 are preferably disposed at an angle 36 of about 48 degrees with respect to the plate 20.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A burner comprising:

(a) a burner tube comprising a side wall, a plurality of apertures disposed on said side wall, a first longitudinal end configured for receiving a fuel mixture flow, a closed second longitudinal end, a chamber defined by the interior flow space of said burner tube, the cross-sectional area of said burner tube is larger at said first longitudinal end than the cross-sectional area of said burner tube at said second longitudinal end; and (b) a plate disposed on the first longitudinal end of the burner tube, isolating said chamber from a space upstream of said chamber, said plate further comprises a plurality of openings disposed in a spiral format on said plate and a plurality of baffles, each baffle coupled to one of said plurality of openings of the plate, each of said plurality of baffles is configured to direct a portion of the fuel mixture flow through one of said plurality of openings from said space upstream of the chamber into said chamber, which together, form a confluent flow in a spiral format in said chamber and subsequently exit through the plurality of apertures of the burner tube, whereby one of a flowrate-induced burner resonance and a flowrate change-induced burner resonance is mitigated when the flowrate decreases below a minimum threshold.

2. The burner of claim 1, wherein at least one of said baffles is disposed at an angle of about 48 degrees with respect to said plate.

3. The burner of claim 1, wherein said flowrate-induced burner resonance is a condition wherein the fuel mixture flowrate is under about 36 kbtu/hr.

4. The burner of claim 1, wherein said flowrate change-induced burner resonance is a condition wherein the fuel mixture flowrate decreases from over about 100 kbtu/hr to under about 40 kbtu/hr.

5. The burner of claim 1, wherein the cross-sectional area of said burner tube is larger at said first longitudinal end than the cross-sectional area of said burner tube at said second longitudinal end due at least in part to a conically shaped member being disposed within said burner tube.

6. The burner of claim 1, the cross-sectional area of said burner tube is larger at said first longitudinal end than the cross-sectional area of said burner tube at said second longitudinal end due at least in part to a frusto-conically shaped member being disposed within said burner tube.

7. The burner of claim 1, wherein said burner tube is configured to taper inwardly from said first longitudinal end of said burner tube to said second longitudinal end of said burner tube.

8. The burner of claim 1, wherein said chamber is configured such that the fuel mixture flowrate is maintained from said first longitudinal end of said burner tube to said second longitudinal end of said burner tube.

9. A burner comprising:

(a) a burner tube comprising a side wall, a plurality of apertures disposed on said side wall, a first longitudinal end configured for receiving a fuel mixture flow, a closed second longitudinal end, a chamber defined by the interior flow space of said burner tube, the cross-sectional area of said burner tube is larger at said first longitudinal end than the cross-sectional area of said burner tube at said second longitudinal end; and (b) a plate disposed on the first longitudinal end of the burner tube, isolating said chamber from a space upstream of said chamber, said plate further comprises a plurality of openings disposed in a spiral format on said plate and a plurality of baffles, each baffle coupled to one of said plurality of openings of the plate, each of said plurality of baffles is configured to direct a portion of the fuel mixture flow through one of said plurality of openings from said space upstream of the chamber into said chamber, which together, form a confluent flow in a spiral format in said chamber and subsequently exit through the plurality of apertures of the burner tube and at least one of said plurality of baffles is disposed at an angle of about 48 degrees with respect to said plate, whereby one of a flowrate-induced burner resonance and a flowrate change-induced burner resonance is mitigated when the flowrate decreases below a minimum threshold.

10. The burner of claim 9, wherein said flowrate-induced burner resonance is a condition wherein the fuel mixture flowrate is under about 36 kbtu/hr.

11. The burner of claim 9, wherein said flowrate change-induced burner resonance is a condition wherein the fuel mixture flowrate decreases from over about 100 kbtu/hr to under about 40 kbtu/hr.

12. The burner of claim 9, wherein the cross-sectional area of said burner tube is larger at said first longitudinal end than the cross-sectional area of said burner tube at said second longitudinal end due at least in part to a conically shaped member being disposed within said burner tube.

13. The burner of claim 9, the cross-sectional area of said burner tube is larger at said first longitudinal end than the cross-sectional area of said burner tube at said second longitudinal end due at least in part to a frusto-conically shaped member being disposed within said burner tube.

14. The burner of claim 9, wherein said burner tube is configured to taper inwardly from said first longitudinal end of said burner tube to said second longitudinal end of said burner tube.

15. The burner of claim 9, wherein said chamber is configured such that the fuel mixture flowrate is maintained from said first longitudinal end of said burner tube to said second longitudinal end of said burner tube.

16. A burner resonance canceling apparatus adapted to a burner tube comprising a side wall, a plurality of apertures disposed on said side wall, a first longitudinal end configured for receiving a fuel mixture flow, a closed second longitudinal end, a chamber defined by the interior flow space of the burner tube, the cross-sectional area of said burner tube is larger at said first longitudinal end than the cross-sectional area of said burner tube at said second longitudinal end, said burner resonance canceling apparatus comprises:

a plate disposed on the first longitudinal end of the burner tube, isolating the chamber from a space upstream of said chamber, said plate further comprises a plurality of openings disposed in a spiral format on said plate and a plurality of baffles, each baffle coupled to one of said plurality of openings of the plate, each of said plurality of baffles is configured to direct a portion of the fuel mixture flow through one of said plurality of openings from said space upstream of the chamber into said chamber, which together, form a confluent flow in a spiral format in said chamber and subsequently exit through the plurality of apertures of the burner tube, whereby one of a flowrate-induced burner resonance and a flowrate change-induced burner resonance is mitigated when the flowrate decreases below a minimum threshold.

17. The burner resonance canceling apparatus of claim 16, wherein at least one of said baffles is disposed at an angle of about 48 degrees with respect to said plate.

18. The burner resonance canceling apparatus of claim 16, wherein said flowrate-induced burner resonance is a condition wherein the fuel mixture flowrate is under about 36 kbtu/hr.

19. The burner resonance canceling apparatus of claim 16, wherein said flowrate change-induced burner resonance is a condition wherein the fuel mixture flowrate decreases from over about 100 kbtu/hr to under about 40 kbtu/hr.

* * * * *